US006397500B1

(12) United States Patent
Hall

(10) Patent No.: US 6,397,500 B1
(45) Date of Patent: Jun. 4, 2002

(54) TRENCHING PLOW WITH RECIPROCATING ACTION

(76) Inventor: Ronald Hall, 168 Argyle Street, Embro, Ontario (CA), N0J 1J0

( * ) Notice: Subject to any disclaimer, the term of this patent is extended or adjusted under 35 U.S.C. 154(b) by 0 days.

(21) Appl. No.: 09/756,275

(22) Filed: Jan. 9, 2001

(51) Int. Cl.[7] ..... E02F 5/10
(52) U.S. Cl. ..... 37/367; 405/182; 172/40
(58) Field of Search ..... 37/367, 366, 370, 37/904; 405/180, 181, 182, 183; 172/40, 720, 699

(56) References Cited

U.S. PATENT DOCUMENTS

| | | | | |
|---|---|---|---|---|
| 3,831,299 | A | | 8/1974 | Kelley |
| 4,087,982 | A | | 5/1978 | Golobay |
| 4,834,581 | A | | 5/1989 | Soules, Jr. |
| 4,861,195 | A | * | 8/1989 | Hillard et al. |
| 4,867,607 | A | * | 9/1989 | Johnson et al. |
| 4,930,589 | A | * | 6/1990 | Henline |
| 5,039,252 | A | * | 8/1991 | Schuermann |
| 5,482,121 | A | * | 1/1996 | Draney et al. |
| 5,765,966 | A | * | 6/1998 | White et al. |
| 5,934,833 | A | | 8/1999 | Hunter et al. |
| 6,126,363 | A | | 10/2000 | Hunter |
| 6,186,242 | B1 | * | 2/2001 | Bricko |
| 6,244,355 | B1 | * | 6/2001 | Hall |
| 6,318,006 | B1 | * | 11/2001 | Hall |

FOREIGN PATENT DOCUMENTS

| | | | | |
|---|---|---|---|---|
| DE | 2705289 | * | 8/1978 | ..... 172/40 |
| FR | 2380379 | * | 10/1978 | ..... 172/40 |
| SU | 581203 | * | 11/1977 | ..... 37/367 |
| SU | 1061714 | * | 12/1983 | ..... 172/40 |

* cited by examiner

*Primary Examiner*—Victor Batson
(74) *Attorney, Agent, or Firm*—R. Craig Armstrong

(57) ABSTRACT

A trenching plow adapted for attachment to a vehicle, the plow having an elongated shank having a blade formed along a lower portion of a leading edge of the shank, the blade having a first soil cutting surface along the leading edge, a first cutting arm pivotably arranged at a forward lower portion of one side of the shank generally parallel to the shank and a second cutting arm arranged at a forward lower portion of an opposite side of the shank generally parallel to the shank. Further, a drive means for reciprocating upper portions of the first arm and the second arm is used.

11 Claims, 11 Drawing Sheets

TRENCHING PLOW WITH RECIPROCATING ACTION

BACKGROUND OF THE INVENTION

1. Field of the Invention

The invention relates to a trenching plow mounted on a carrier vehicle, such as a tractor. More specifically, the trenching plow has a pair of cutting arms adjacent the lower soil cutting portion of the plow, to provide a shearing action between each arm and the cutting portion of the plow and/or a shearing action between the arms. This greatly enhances the cutting ability of the plow.

2. Description of the Prior Art

In the past, different approaches have been tried to provide trench cutting machines. Common are the chain or wheel cutting trenchers, where a chain having cutting edges is rotated along a blade or wheel, to cut into the soil, see for instance U.S. Pat. No. 3,831,299 (Kelley). These trenchers have high maintenance costs because they have a large number of parts which are under high stress. They are also dangerous to work with, because the return chain, i.e. the part of the chain which is not cutting into the soil, is exposed to the air and thus a potential hazard. These trenchers necessarily produce trenches having vertical sides and have difficulties to work in confined areas.

A further type of trencher employs a rotating shaft having cutting tool bits radially arranged on the shaft, see for instance U.S. Pat. No. 5,224,797 (Vaughan). When the shaft is rotated and forced into the soil, a trench is cut. Trenchers of this type also have high maintenance costs because they have a large number of parts which are under high stress.

A cable laying plow having a root cutting arrangement is shown in U.S. Pat. No. 4,834,581 (Soules, Jr.). The plow has a shank having a longitudinal blade formed in the leading edge of a lower portion of the shank and having a flat transverse cutting surface above the blade. A cutter having a sharpened lower end is movable with respect to the shank into engagement with the flat cutting surface by a double acting hydraulic cylinder. The cutter and the cylinder rod move between parallel mounting flanges of a vehicle, allowing the hydraulic cylinder itself to be attached to the shank above the mounting flanges. The cutter thus moves reciprocally along the leading edge of the plow blade, and any roots or similar obstacles that collect on the leading edge of the plow may be cut off so they are no longer stuck on the leading edge. The cutter does not enhance or help the trench forming effort itself.

A pipe or cable laying vibratory plow is described in U.S. Pat. No. 6,126,363 (Hunter). The plow has a V-shaped blade with two independently oscillating blade arms, that are not connected at their lower ends. Each blade is free to move in the plane of the blade without interference from and independently of the other blade arm. A perceived problem with this construction is the relatively fragile construction, since the blade is only supported at its top, which seems prone to breakage and thus a cause for high cost of operation. Also, the arrangement with the oscillating arms forming a relatively broad V inherently requires a large power input, compared to a more compact one-blade plow.

SUMMARY OF THE INVENTION

It is an object of the invention to provide an improved trenching plow, that enhances the shearing action of the plow as it is moved through the soil whilst using few parts and parts that are large enough to withstand severe stress conditions during extended use periods. The trenching plow according to the invention has several advantages over known trenching plows or other machines used for trenching: it leaves a trench with very clean sides, it pries rocks from the ground by efficiently pushing them up from below, the trenching operation can be performed at a higher speed than for known trenchers, the width of the trench can be adjusted easily and quickly, and the side walls may be tapered to prevent side wall cave-in.

In the invention, a trenching plow adapted for attachment to a vehicle is described. The plow comprises an elongated shank having a blade formed along a lower portion of a leading edge of the shank, the blade having a first soil cutting surface along the leading edge, a first cutting arm pivotably arranged at a forward lower portion of one side of the shank generally parallel to the shank and a second cutting arm arranged at a forward lower portion of an opposite side of the shank generally parallel to the shank. Further, a drive means for reciprocating upper portions of the first arm and the second arm is used.

Preferably, the first cutting arm has a short portion, extending forwards and downwards from the pivot axis, and a long portion, extending backwards and upwards from the pivot axis, and the second cutting arm similarly has a short portion, extending forwards and downwards from the pivot axis, and a long portion, extending backwards and upwards from the pivot axis.

In one embodiment of the invention, the first cutting arm and the second cutting arm move in a scissor movement, so that when the first arm is moving with its short portion in a forward direction, the short portion of the second arm is moving in a rearward direction.

Advantageously, the long portion of the first arm is connected to the drive means via a first connecting rod and the long portion of the second arm is connected to the drive means via a second connecting rod. The first connecting rod preferably has a first small end and a first large end, the first small end being connected to the first arm and the first large end being eccentrically connected to the drive means. Similarly, the second connecting rod preferably has a second small end and a second large end, the second small end being connected to the second arm and the second large end being eccentrically connected to the drive means, so that the drive means imparts an eccentric movement to the first large end and the second large end, respectively, causing the first connecting rod and the second connecting rod to move reciprocically in a direction rearwards downwards from the drive means, thus causing the first arm and the second arm to pivot around the pivot axis, preferably in a scissor movement.

The first arm advantageously has a cutting edge arranged at a leading edge of the first arm, and the second arm has a cutting edge arranged at a leading edge of the second arm.

The plow further preferably comprises means to raise and lower the plow with respect to the vehicle.

The plow further advantageously comprises a first feeding means hingedly attached to a trailing edge of the shank, for directing an elongate material to be buried in the trench down into the trench behind the plow. The first feeding means preferably has a top soil displacement means arranged at a top of the first feeding means, for depositing soil moved to the surface of the ground during operation of the plow at either side of the plow. The displacement means advantageously comprises an Archimedean screw and reversible propulsion means, for rotating the screw in a chosen direction of rotation. The top soil displacement means is preferably raised or lowered, with respect to the shank, using a biasing means, preferably a hydraulic cylinder.

The plow further preferably comprises a second feeding means hingedly attached to a trailing edge of the first feeding means, for directing a further elongate material to be buried in the trench down into the trench behind the plow.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE INVENTION

Figure 6:
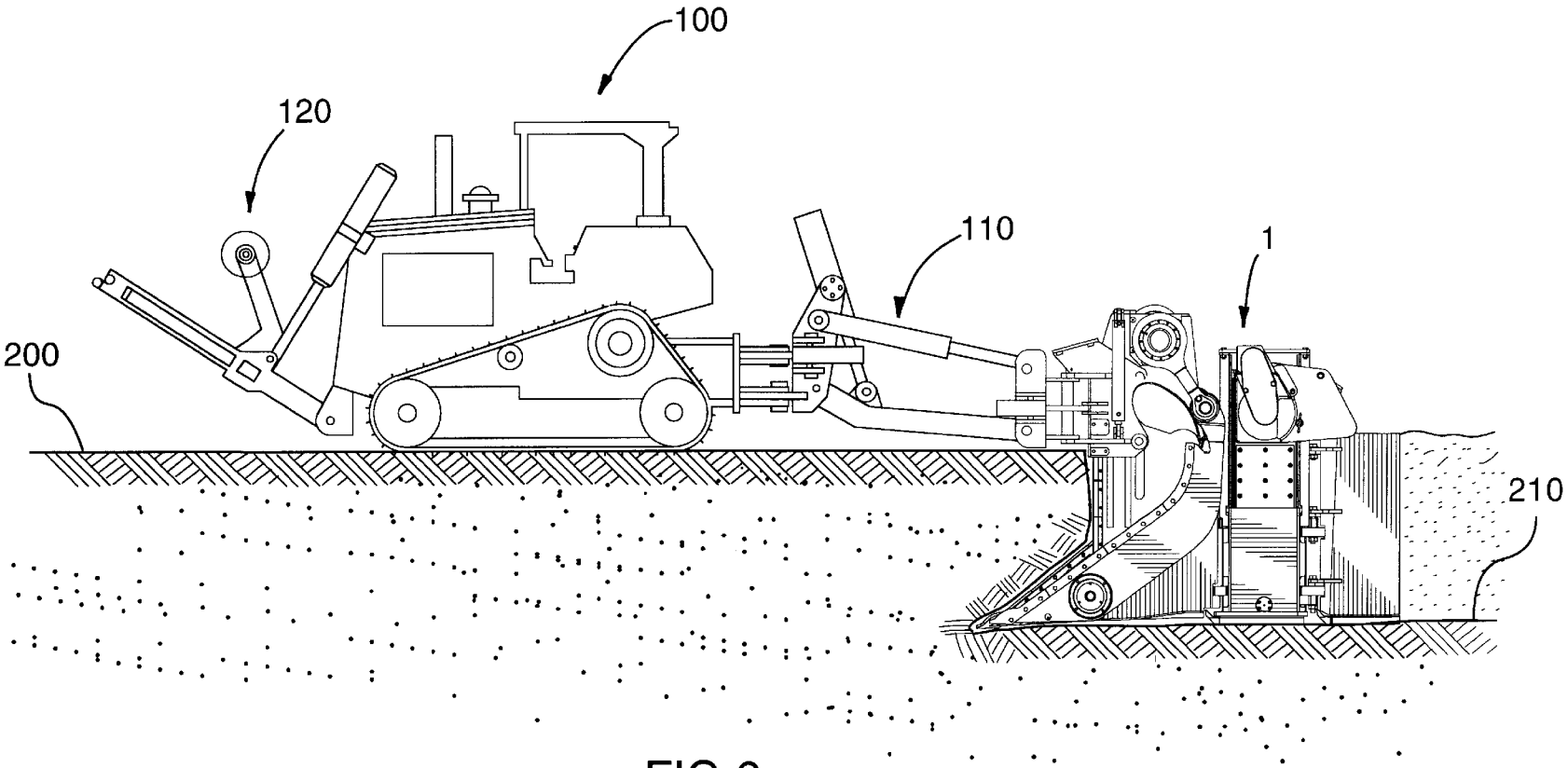
FIG. 6 is a schematic side view of the trenching plow attachment of FIG. 1A attached to a vehicle.
Figure 7:
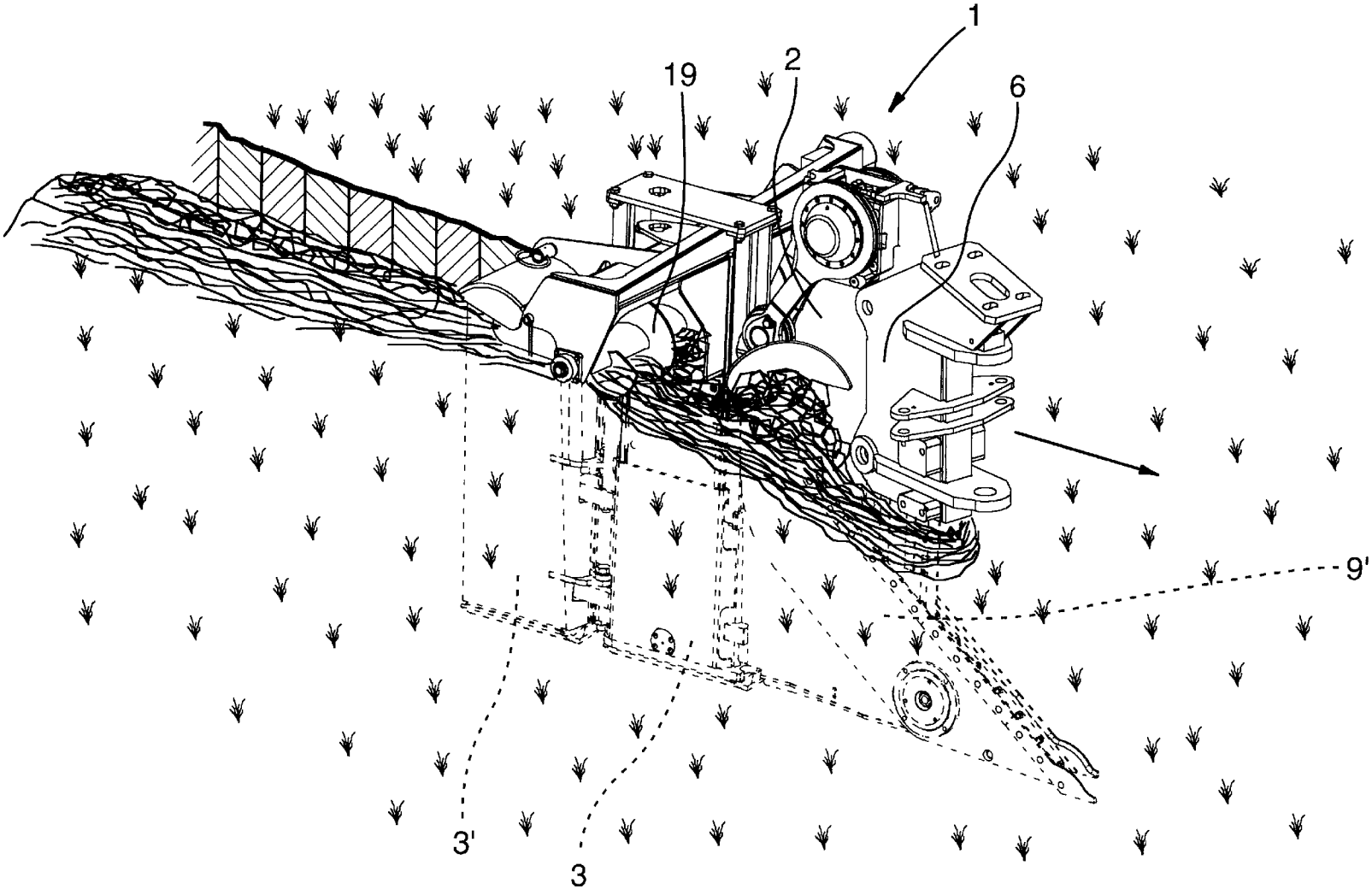
FIG. 7 is a schematic elevated view of the trenching plow attachment of FIG. 1A, seen from the right side when facing the direction of travel of the trenching plow attachment and showing the trenching plow attachment during use with the flow of the removed soil.
Figure 8:
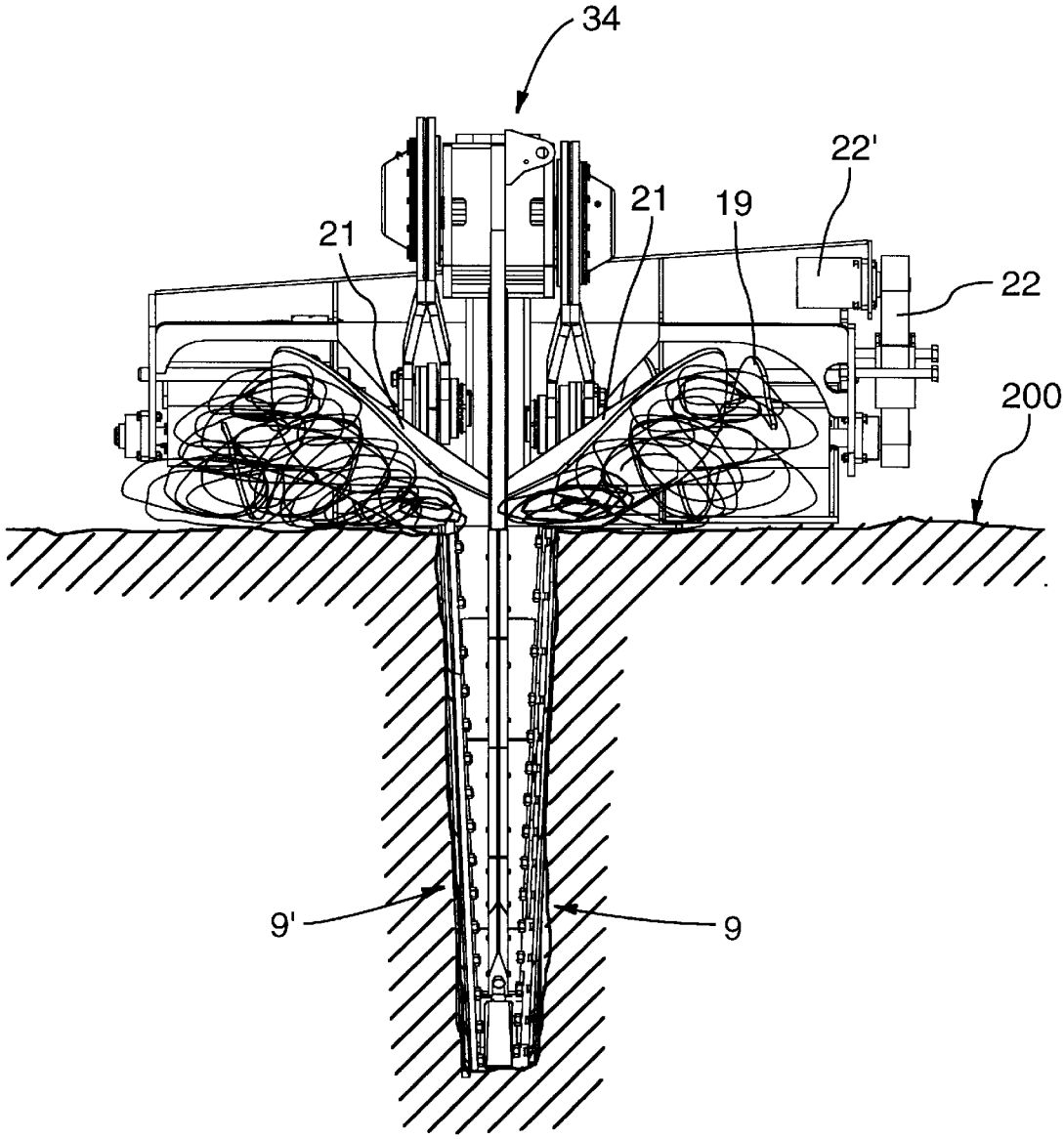
FIG. 8 is a schematic end view of the trenching plow attachment of FIG. 1A, seen from the front and showing the trenching plow attachment during use with the flow of the removed soil.
Figure 9:
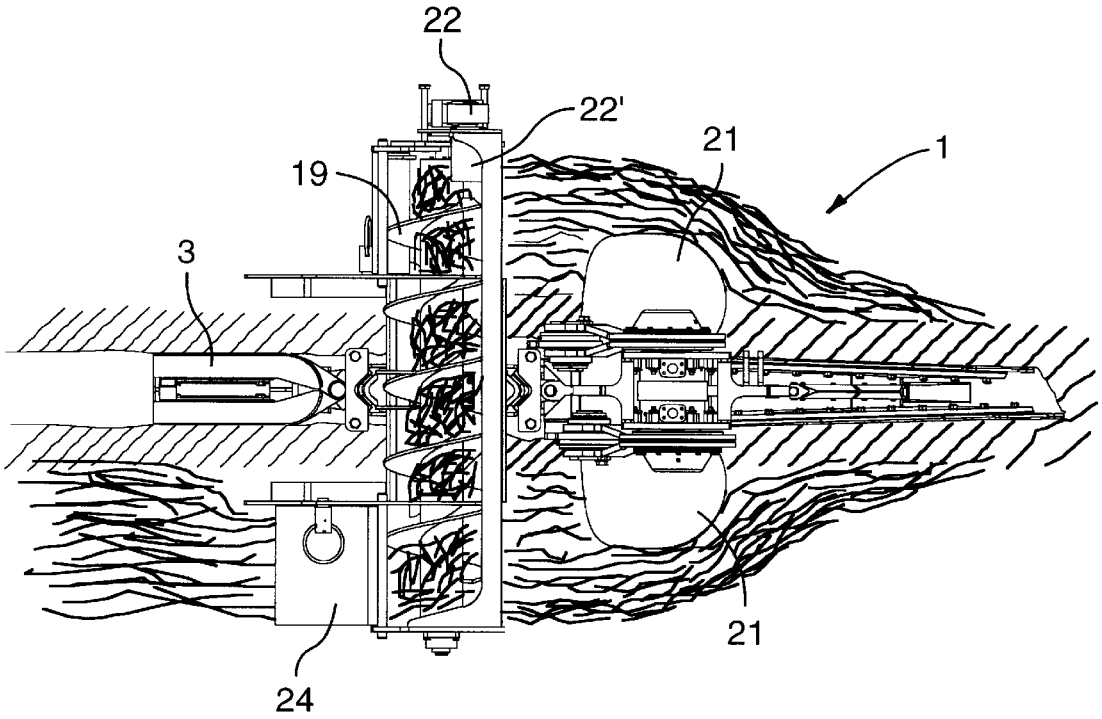
FIG. 9 is a schematic top view of the trenching plow attachment of FIG. 1A, showing the trenching plow attachment during use with the flow of the removed soil.
Figure 10:
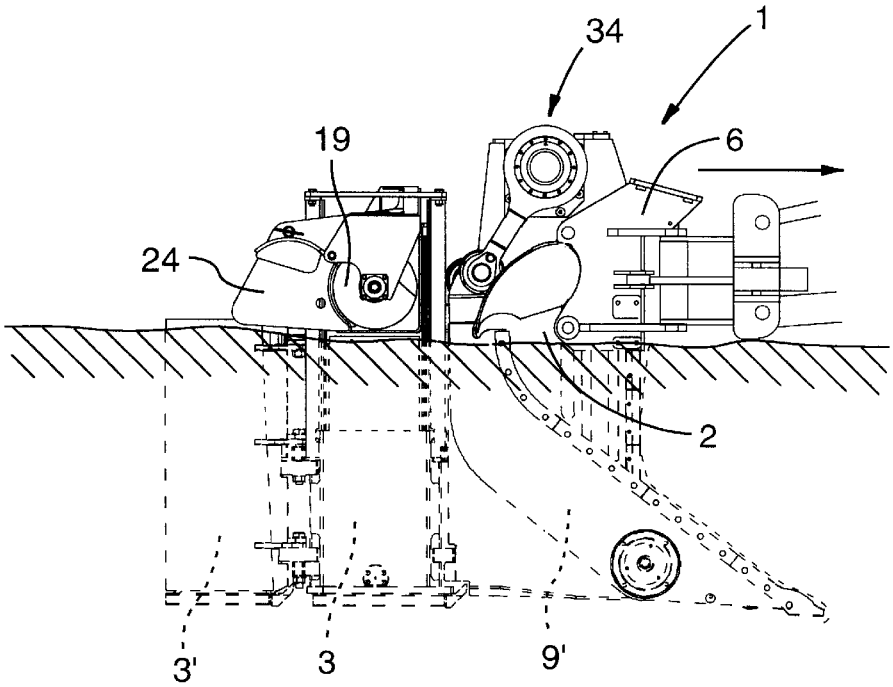
FIG. 10 is a schematic side view of the trenching plow attachment of FIG. 1A, seen from the right side when facing the direction of travel of the trenching plow attachment and showing the trenching plow attachment during use with the flow of the removed soil.

FIGS. 1A to FIG. 5 show a trenching plow attachment 1, according to the invention, for mounting on a vehicle. FIG. 6 shows the general arrangement of the trenching plow attachment 1 mounted onto the movable boom structure 110 of the vehicle 110. The vehicle may have a holder 120 for holding whatever product is going to be placed in the trench formed by the plow, for example flexible cable or pipe un-coiled from a drum or a trench bottom covering material. The vehicle is driving on the upper surface of the ground 200, the trench depth 210 being adjustable, as will be shown later.

Figure 1A:
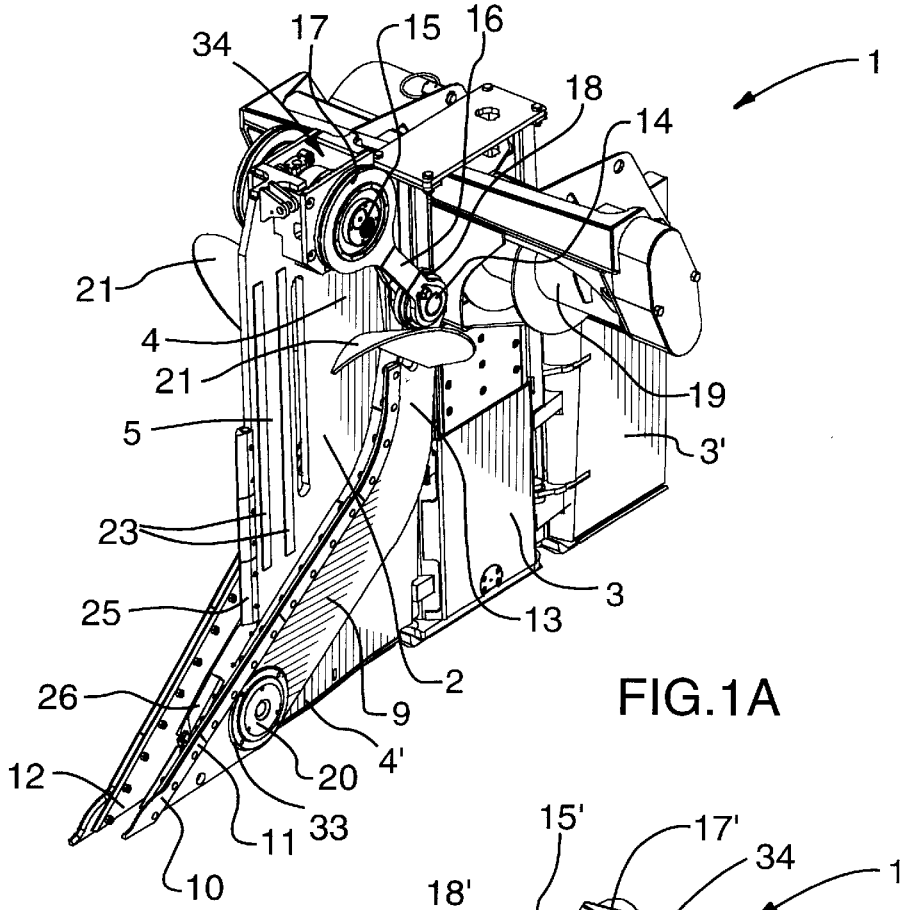
FIG. 1A is a schematic elevational side view of a trenching plow attachment according to the invention, seen from the left side when facing the direction of travel of the trenching plow attachment.
Figure 1B:
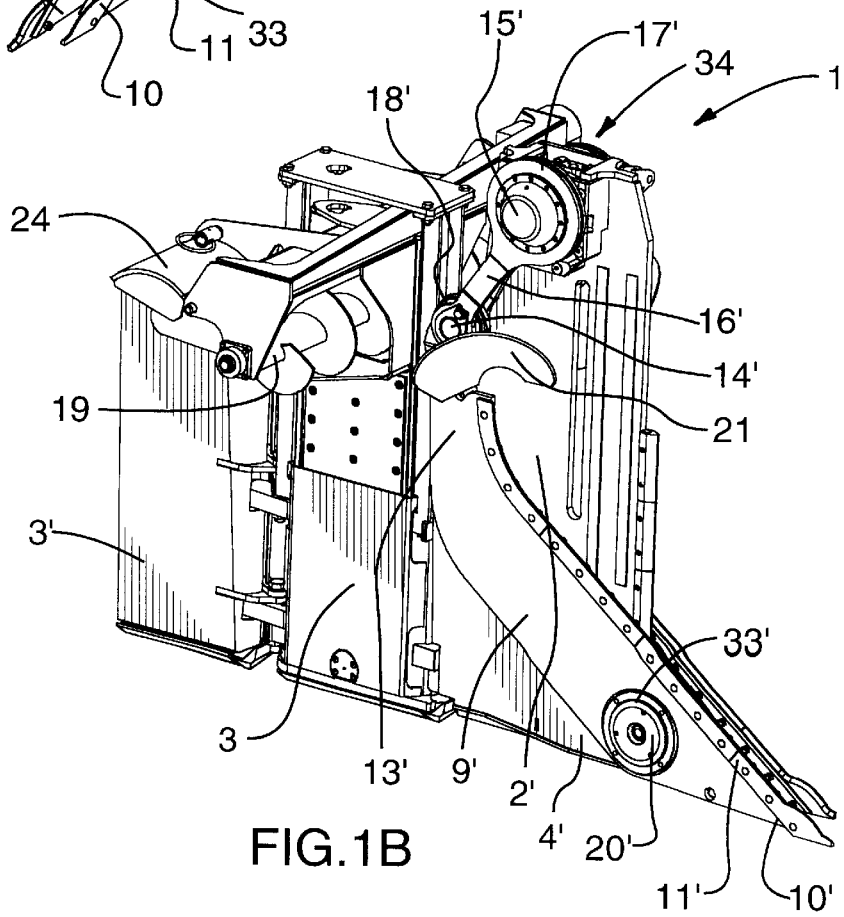
FIG. 1B is a schematic elevational side view of the trenching plow attachment according to FIG. 1A, seen from the right side when facing the direction of travel of the trenching plow attachment.
Figure 1C:
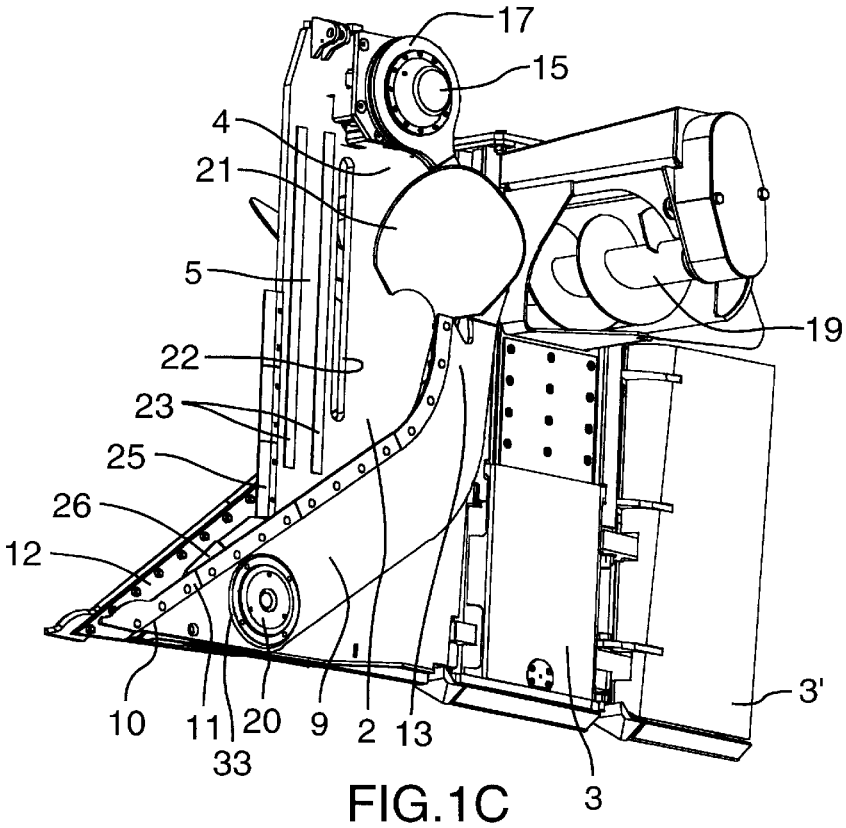
FIG. 1C is a schematic perspective side view from below of the trenching plow attachment according to FIG. 1A, seen from the left side when facing the direction of travel of the trenching plow attachment.

FIGS. 1A to 1C show the trenching plow attachment 1 as it is ready to be used for making a trench and optionally placing a product in the trench. The attachment has an elongated shank 2, which has an upper part 4 and a lower part 4'. The lower part has a cutting edge formed on its leading edge, the cutting edge preferably having an upper part 25 and a lower part 26. The upper part of the cutting edge is attached to the leading edge of the upper part of the shank, and the lower part of the cutting edge is attached to the lower part of the shank. The lower part of the shank preferably forms the toe part of a plow blade, as is known in the art.

The shank 2 is hingedly connected to a first feeding means 3, so that a trailing edge of the shank faces a leading edge of the first feeding means. The first feeding means is arranged to guide a product to be buried in the trench down inside the trench to a bottom of the trench, behind the shank 2. In addition, the first feeding means 3 also assists in forming the trench behind the shank. Advantageously, a second feeding means 3' is hingedly connected to the first feeding means 3, so that a trailing edge of the first feeding means faces a leading edge of the second feeding means. The second feeding means is arranged to guide a product to be buried in the bottom of the trench behind the first feeding means 3, for example a covering strip or similar (to cover the first product). The second feeding means 3' also assists in forming the trench, similar to the first feeding means. Optionally, the plow is used to only form the trench without simultaneously placing a product in the trench. This would be the case, for instance, when trenching for rigid pipes, which cannot be unreeled from a drum. The pipes would be placed in the trench individually as the trench is formed, and joined together forming an unbroken pipe-line.

The shank 2 is movable up- and down, between a fully raised position and a fully lowered position, with respect to the movable boom structure of the vehicle and with respect to the ground surface, preferably by being slidably mounted to the boom structure (or other equivalent part of the vehicle). To hold the shank and guide the shank in the movement, the shank has an elongate, vertical slot 22 and at least one elongate, vertical ridge 23. Both the slot and the ridge(s) cooperate with a mounting portion 6 of the boom structure to allow the shank to move as described. The movement may be provided by a hydraulic cylinder 7, for example, arranged on the boom structure and on the shank 2. The plow is horizontally pivotable, with respect to the boom structure, for instance by attaching the plow to the boom via a hinge 8.

The trenching plow according to the invention further has a first cutting arm 9 pivotably arranged at a forward lower portion of one side of the lower part 4' of the shank 2 generally parallel to said shank or slightly tilted. The first cutting arm has an upper part 13 and a lower part 10, stretching from a central part 33 of the first cutting arm. The central part is rotatably fastened to a first pivot boss 20, fastened to the lower part 4' of the shank 2. A second cutting arm 9' is arranged at a forward lower portion of an opposite side of the shank, in the same way as the first cutting arm 9. The second cutting arm has an upper part 13' and a lower part 10', stretching from a central part 33' of the second cutting arm. The central part is rotatably fastened to a second pivot boss 20', fastened to the lower part 4' of the shank 2 opposite the first pivot boss 20.

The longitudinal axis of the first pivot boss 20 and the second pivot boss 20' are generally parallel or slightly angled, so that the first cutting arm 9 and the second cutting arm 9' form an open V, where the lower part 10 of the first cutting arm and the lower part 10' of the second cutting arm are closer together than the upper part 13 of the first cutting arm and the upper part 13' of the second cutting arm, but the first cutting arm and the second cutting arm never touch each other. Further, a drive means 34 is arranged at a top of the upper part 4 of the shank 2, for rotatingly reciprocating the first cutting arm and the second cutting arm around the first pivot boss 20 and the second pivot boss 20', respectively. The drive means is preferably a hydraulic motor, alternatively an electric motor or a drive mechanism which derives its power from the vehicle.

The lower part 10 of the first cutting arm 9 extends forwards and downwards from the first pivot boss 20, and the upper part 13 of the first cutting arm extends backwards and upwards from the first pivot boss. The lower part 10' of the second cutting arm 9' extends forwards and downwards from the second pivot boss 20', and the upper part 13' of the second cutting arm extends backwards and upwards from the second pivot boss. All directions are relative the intended travel direction of the vehicle, forwards being the direction in which the vehicle will travel during trenching operations. When propelled by the drive means 34, the first cutting arm 9 and the second cutting arm 9' move in a scissor movement, so that when the first cutting arm is moving with its lower part 10 in a forward direction, the lower part of the second cutting arm is moving in a rearward direction. Alternatively, the cutting arms can be made to move in unison, so that the respective lower parts move in the same direction, or the rocking motion of each cutting arm can be of different speeds to create a more random cutting action.

In one embodiment of the invention, the upper part 13 of the first cutting arm 9 is connected to the drive means 34 via a first connecting rod 16, and the upper part 13' of the second arm 9' is connected to the drive means via a second connecting rod 16'. The first connecting rod has a first small end 18 and a first large end 17, the first small end being connected to the upper part 13 of the first cutting arm and the first large end being eccentrically connected to a first drive boss 15 of the drive means 34, arranged on the same side of the shank as the first cutting arm. The second connecting rod 16' has a second small end 18' and a second large end 17', the second small end being connected to the upper part 13' of the second cutting arm and the second large end being eccentrically connected to a second drive boss 15' of the drive means 34, arranged on the same side of the shank as the second cutting arm. The drive means thus imparts an eccentric movement to the first large end and the second large end, respectively, causing the first connecting rod and the second connecting rod to move reciprocally in a direction rearwards downwards from the drive means, thus causing the first arm and the second arm to pivot around the respective pivot boss in a scissor movement.

The shank 2 further advantageously has soil deflection plates 21 arranged on each side of the upper part 4 of the shank. The deflection plates direct any soil spray from the plow operation away from the cutting arm propulsion arrangement.

Figure 1D:
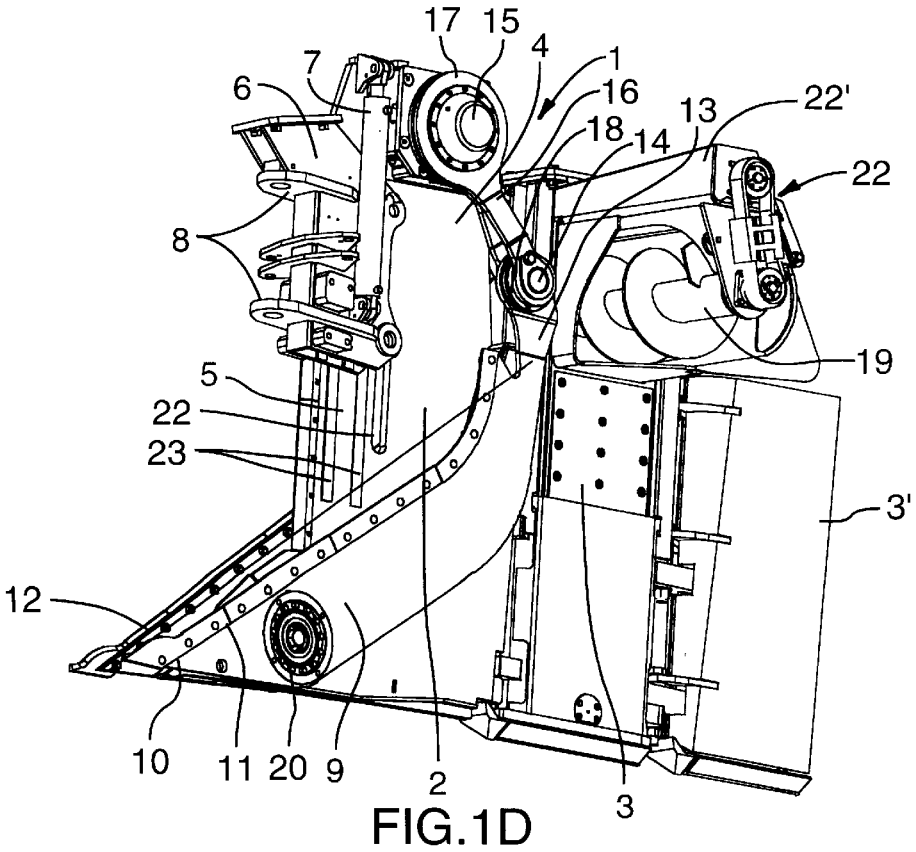
FIG. 1D is a schematic perspective side view from below of the trenching plow attachment according to FIG. 1A, seen from the left side when facing the direction of travel of the trenching plow attachment, showing a movable mounting means for mounting the trenching plow attachment onto a vehicle.

The first feeding means 3 advantageously has a top soil displacement means 19 arranged at a top of the first feeding means. When a top soil displacement means is used, the soil deflection plates 21 may advantageously be omitted from the shank 2. The top soil displacement means 19 is preferably a driven auger rotating in a chosen direction, to move soil from one side of the plow to the other side, thus leaving a single string of top soil after the trenching operation. One embodiment of auger drive is shown in FIG. 1D, a motor 22' drives the auger 19 via a belt 22. Other alternatives are directly driven auger, or an auger driven by the cutting arm propulsion unit, as described above. The top soil displacement means 19 preferably comprises an Archimedean screw and reversible propulsion means 22', for rotating said screw in a chosen direction of rotation. A removable soil directing plate 24 is attachable to either side of the top soil displacement means 19, for directing the soil transported from one side of the trench to the other into a neat and compact string, as opposed to a more uneven string which would be the result if the soil directing plate was not used. The soil directing plate can be used on either side, and only one plate is used since the top soil displacement means will transport substantially all of the top soil deposit from one side of the trench to the other side.

Figure 1E:
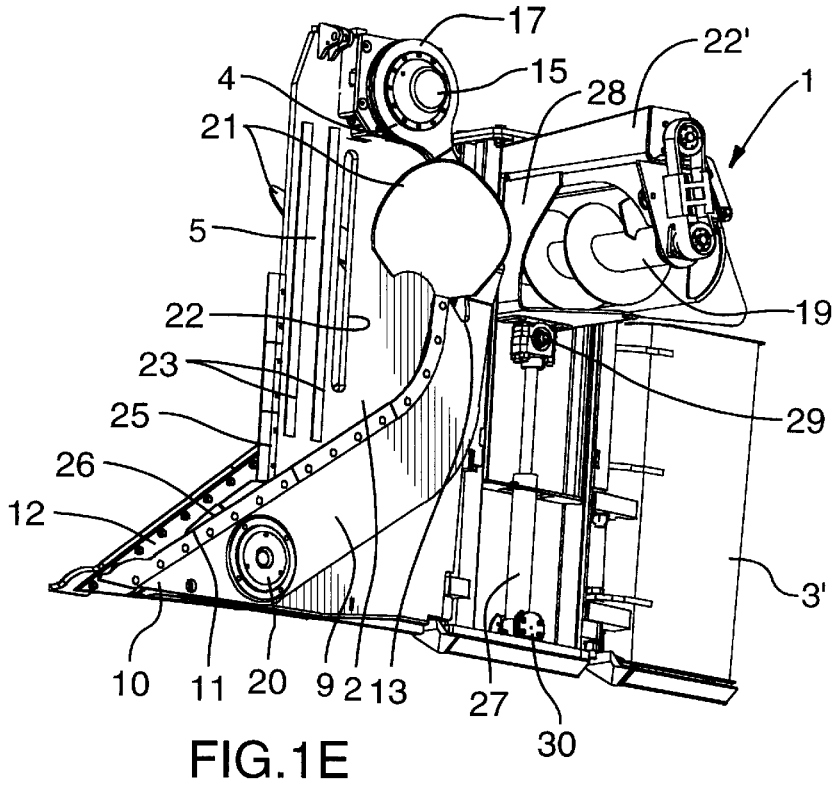
FIG. 1E is a schematic perspective side view from below of the trenching plow attachment according to FIG. 1A, seen from the left side when facing the direction of travel of the trenching plow attachment, showing a biasing means for the top soil displacement means.
Figure 1F:
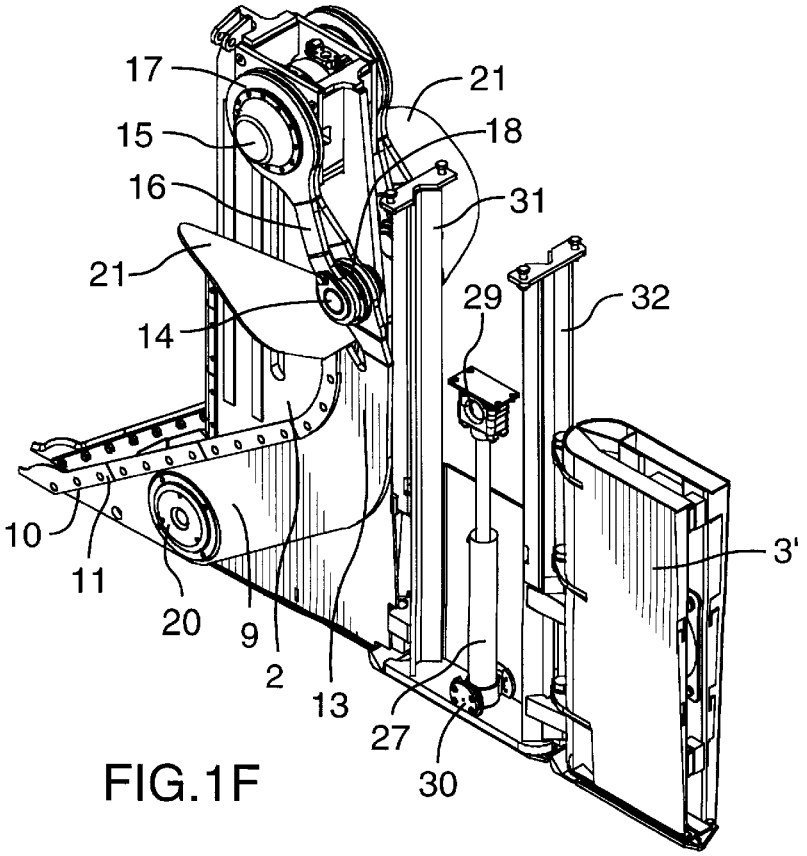
FIG. 1F is a schematic elevational side view of the trenching plow attachment according to FIG. 1E, seen from the left side when facing the direction of travel of the trenching plow attachment.
Figure 2A:
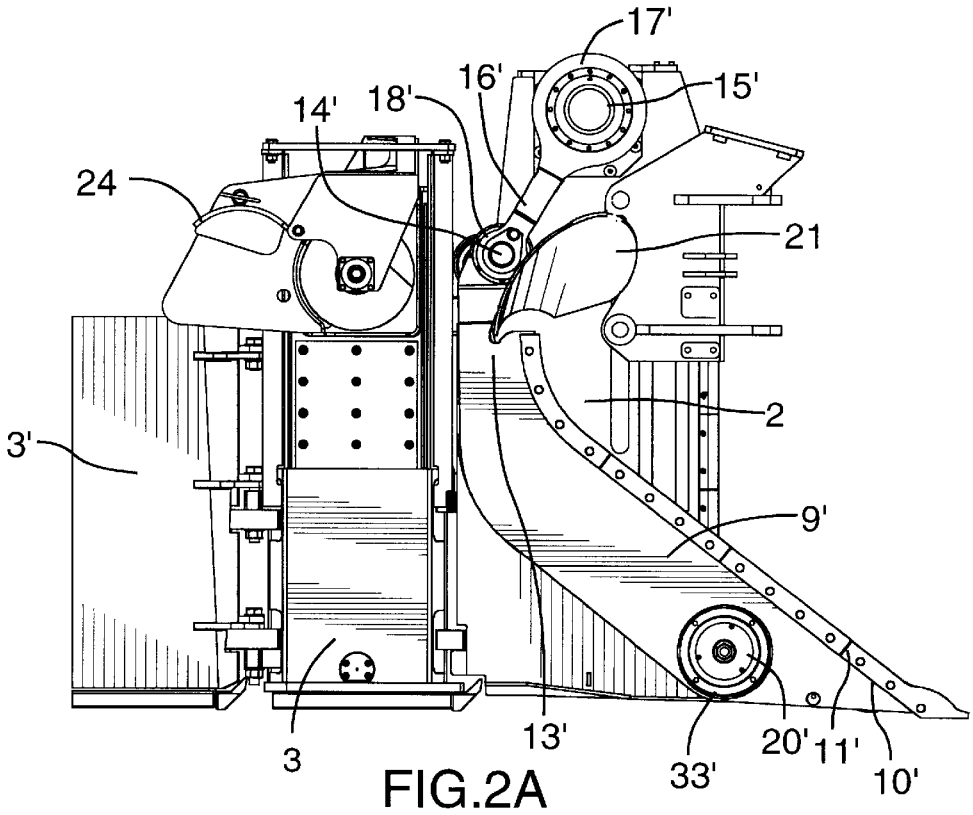
FIG. 2A is a schematic side view of the trenching plow attachment of FIG. 1A, seen from the right side when facing the direction of travel of the trenching plow attachment.
Figure 2B:
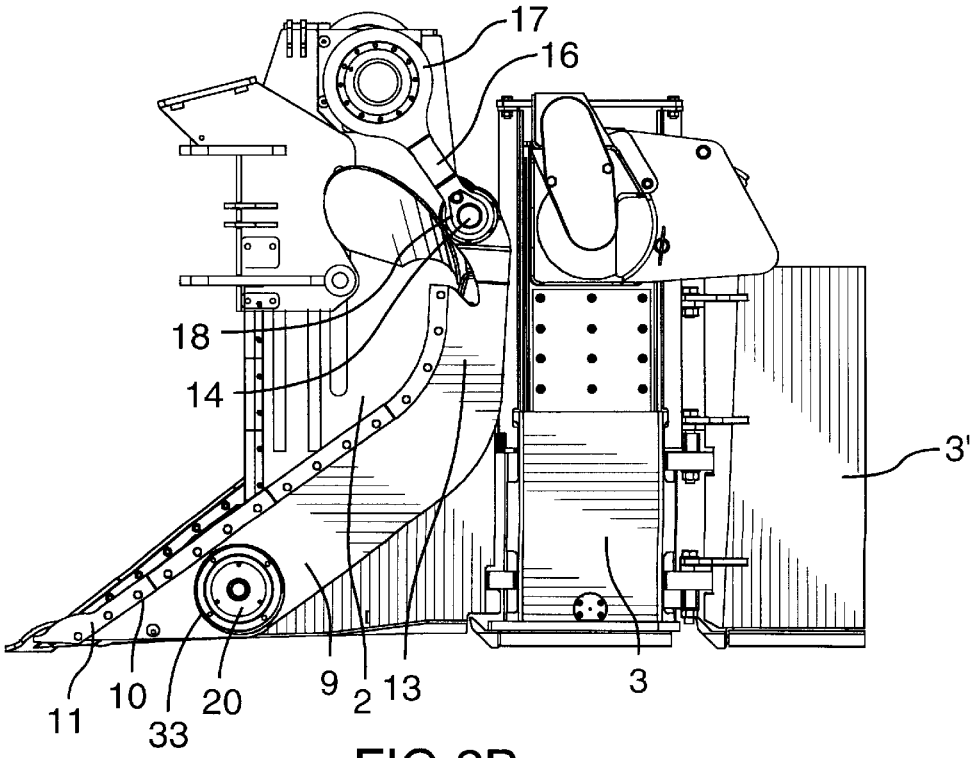
FIG. 2B is a schematic side view of the trenching plow attachment of FIG. 1A, seen from the left side when facing the direction of travel of the trenching plow attachment.
Figure 3A:
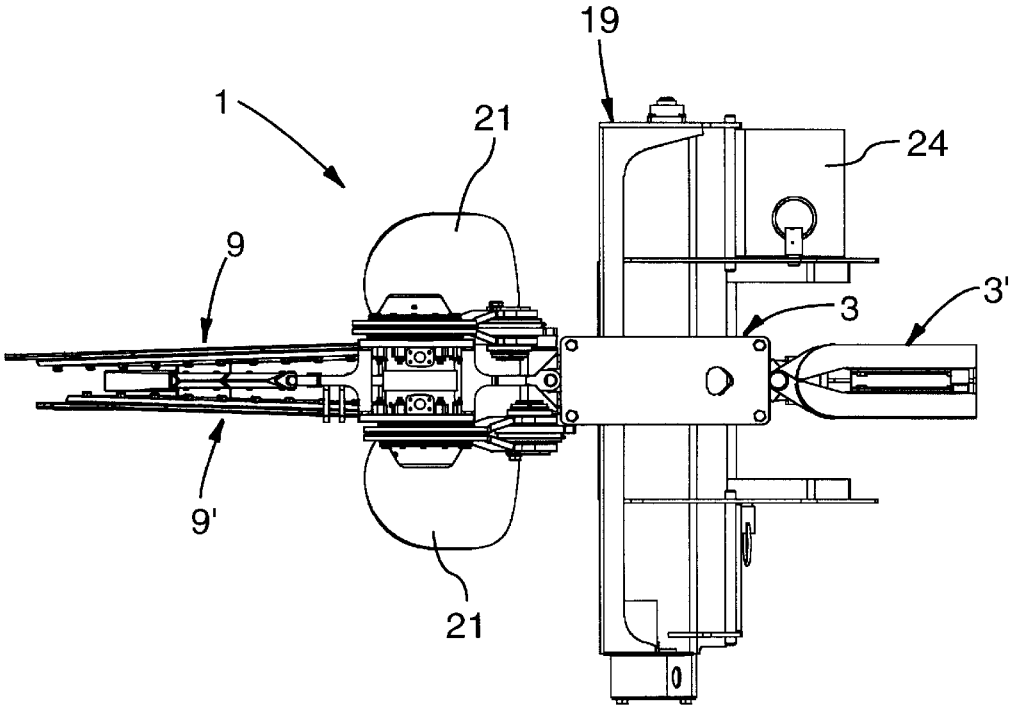
FIG. 3A is a schematic top view of the trenching plow attachment of FIG. 1A.
Figure 3B:
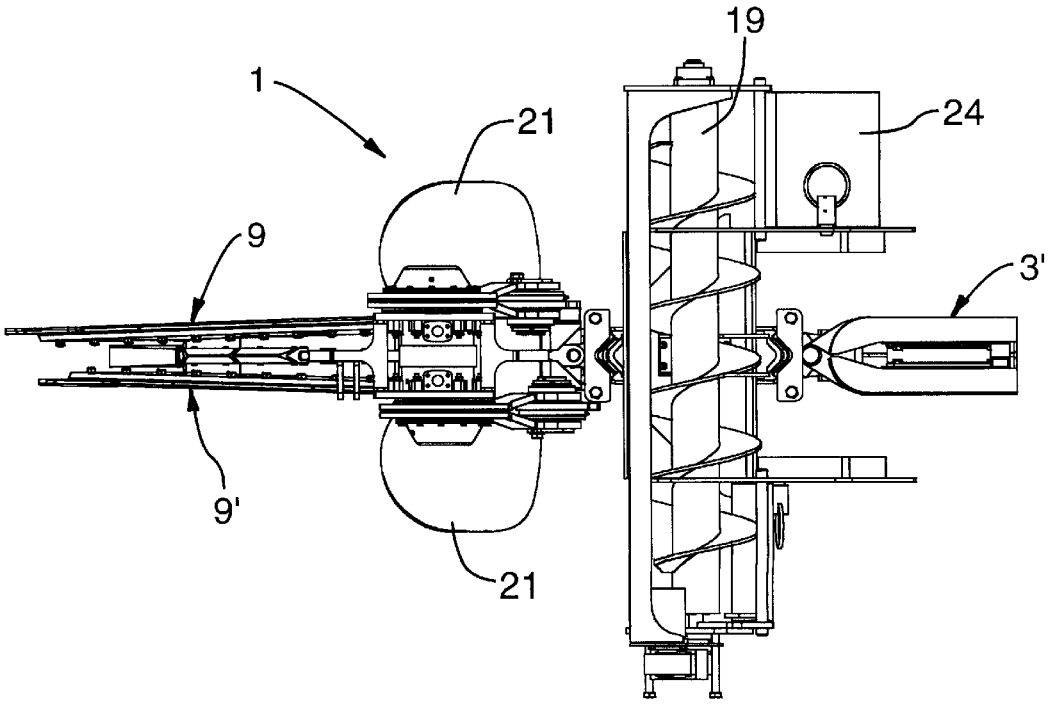
FIG. 3B is a schematic top view of the trenching plow attachment of FIG. 1A, showing the top soil displacement means.
Figure 4A:
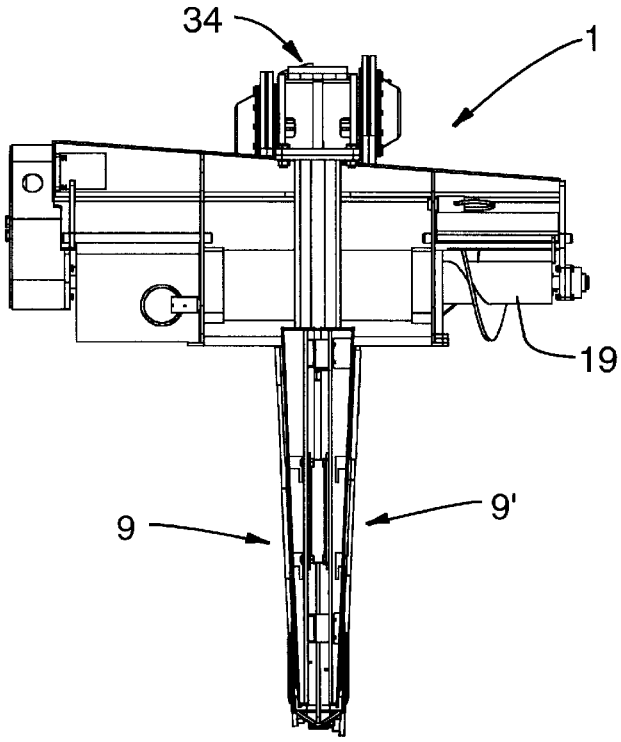
FIG. 4A is a schematic end view of the trenching plow attachment of FIG. 1A, seen from the rear.
Figure 4B:
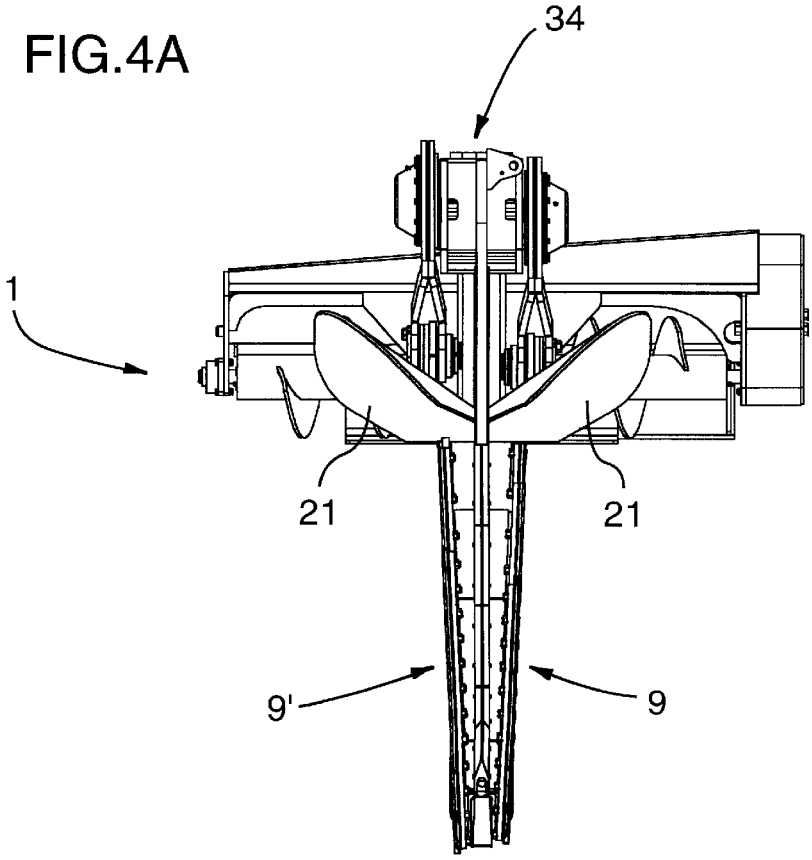
FIG. 4B is a schematic end view of the trenching plow attachment of FIG. 1A, seen from the front.
Figure 5:
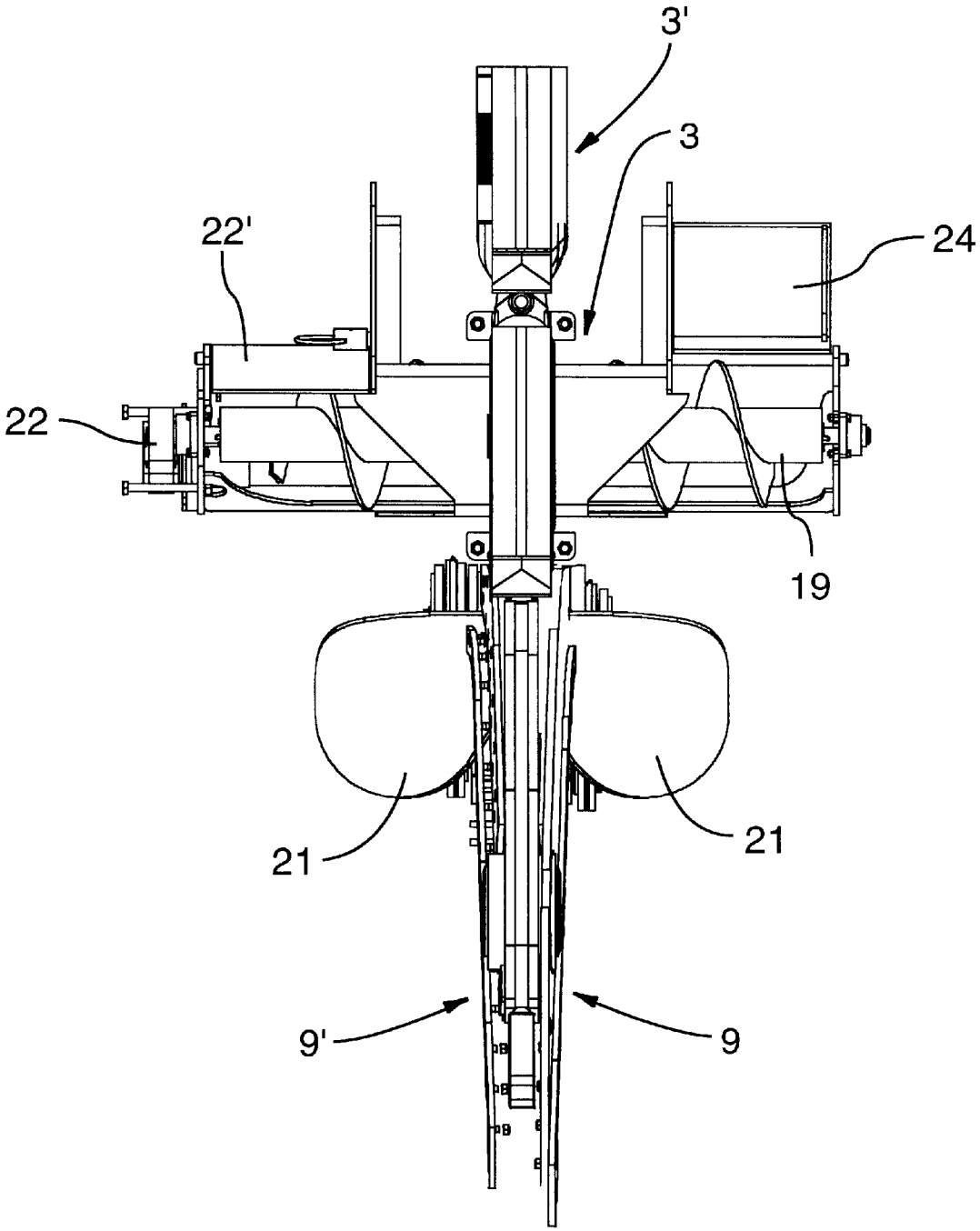
FIG. 5 is a schematic bottom view of the trenching plow attachment of FIG. 1A.

Advantageously and as shown in FIGS. 1E and 1F, the top soil displacement means 19 is movable vertically, with respect to the general plane of the ground and generally parallel to the longitudinal direction of the shank 2. A biasing means 27, preferably a hydraulic cylinder, is advantageously attached to or near a bottom of the first feeding means 3 at a first end attachment 30 and further attached to a housing 28 of the top soil displacement means 19 at a second end attachment 29. The housing is preferably slidably held by a first frame rail 31 and a second frame rail 32, which preferably constitute the leading and trailing edges of the first feeding means 3. The top soil displacement means is thus movable, relative the shank 2, to compensate for any variations in the ground surface position so that the top soil displacement means can be made to follow any undulations or other shape deviations from the general ground plane. The operation of the biasing means 27 is either manual, with the vehicle operator manually adjusting the height of the top soil displacement means relative the shank, or automatic, where a sensor (not shown) is measuring the distance from a fixed position on the shank to the ground surface and adjusting the height position of the top soil displacement means accordingly, to position the top soil displacement means for optimum operation (i.e. not too far off the ground surface, but not too far in the top soil layer). The soil transport thus takes place across the upper part of the first feeding means 3, before the trench is left open. In this way, soil may be transported from one side of the trench to the other side without spilling any soil into the trench.

FIGS. 2A to 5 show the trenching plow attachment according to the invention from different plan views.

FIGS. 7 to 10 show the general flow of soil during actual the trenching operation, the vehicle has been omitted for clarity.

It will be appreciated that the above description relates to the preferred embodiments by way of example only. Many variations on the invention will be obvious to those knowledgeable in the field, and such obvious variations are within the scope of the invention as described and claimed, whether or not expressly described. For example, the drive for the first and second cutting arms have been shown using connecting rods having an eccentric rotation. The invention is not limited to this particular type of drive, although it is favourable from both an engineering and an economic point of view. Alternatively, a drive arrangement using a hydraulic cylinder working on the upper part of each cutting arm can also e employed, or any equivalent drive system which can provide the desired movement of the cutting arms.

What is claimed is:

1. A trenching plow adapted for attachment to a vehicle, said plow comprising:

an elongated shank having a blade formed along a lower portion of a leading edge of said shank, said blade having a first soil cutting surface along said leading edge;

a first cutting arm pivotably arranged at a forward lower portion of one side of said shank generally parallel to said shank;

a second cutting arm arranged at a forward lower portion of an opposite side of said shank generally parallel to said shank;

a drive means for reciprocating upper portions of said first arm and said second arm.

2. The trenching plow as recited in claim 1, wherein said first cutting arm has a short portion, extending forwards and downwards from said pivot axis, and a long portion, extending backwards and upwards from said pivot axis, and said second cutting arm has a short portion, extending forwards and downwards from said pivot axis, and a long portion, extending backwards and upwards from said pivot axis.

3. The trenching plow as recited in claim 1, wherein said first cutting arm and said second cutting arm move in a scissor movement, so that when said first arm is moving with its short portion in a forward direction, said short portion of said second arm is moving in a rearward direction.

4. The trenching plow as recited in claim 2, wherein said long portion of said first arm is connected to said drive means via a first connecting rod and said long portion of said second arm is connected to said drive means via a second connecting rod.

5. The trenching plow as recited in claim 4, wherein said first connecting rod has a first small end and a first large end, said first small end connected to said first arm and said first large end eccentrically connected to said drive means, and said second connecting rod has a second small end and a second large end, said second small end connected to said second arm and said second large end eccentrically connected to said drive means, so that said drive means imparts an eccentric movement to said first large end and said second large end, respectively, causing said first connecting rod and said second connecting rod to move reciprocically in a direction rearwards downwards from said drive means, thus causing said first arm and said second arm to pivot around said pivot axis in a scissor movement.

6. The trenching plow as recited in claim 2, wherein said first arm has a cutting edge arranged at a leading edge of said first arm, and said second arm has a cutting edge arranged at a leading edge of said second arm.

7. The trenching plow as recited in claim 1, wherein said plow further comprises means to raise and lower said plow with respect to said vehicle.

8. The trenching plow as recited in claim 7, wherein said plow further comprises a first feeding means hingedly attached to a trailing edge of said shank, for directing an elongate material to be buried in the trench down into said trench behind said plow.

9. The trenching plow as recited in claim 8, wherein said first feeding means has a top soil displacement means arranged at a top of said first feeding means, for depositing soil moved to the surface of the ground during operation of said plow at either side of said plow.

10. The trenching plow as recited in claim 9, wherein said displacement means comprises an Archimedean screw and reversible propulsion means, for rotating said screw in a chosen direction of rotation.

11. The trenching plow as recited in claim 8, wherein said plow further comprises a second feeding means hingedly attached to a trailing edge of said first feeding means, for directing a further elongate material to be buried in the trench down into said trench behind said plow.

* * * * *